US010488050B2

(12) United States Patent
Puskarich

(10) Patent No.: US 10,488,050 B2
(45) Date of Patent: Nov. 26, 2019

(54) WOOD STOVE INSERT

(71) Applicant: David Puskarich, Larimer, PA (US)

(72) Inventor: David Puskarich, Larimer, PA (US)

( * ) Notice: Subject to any disclaimer, the term of this patent is extended or adjusted under 35 U.S.C. 154(b) by 178 days.

(21) Appl. No.: 15/584,114

(22) Filed: May 2, 2017

(65) Prior Publication Data

US 2018/0320902 A1 Nov. 8, 2018

(51) Int. Cl.
*F24B 1/00* (2006.01)
*F24B 13/02* (2006.01)

(52) U.S. Cl.
CPC ..... *F24B 13/02* (2013.01)

(58) Field of Classification Search
USPC ..... 126/552, 553
See application file for complete search history.

(56) References Cited

U.S. PATENT DOCUMENTS 1,456,898 A * 5/1923 Mansfield ..... 126/147
2,533,783 A * 12/1950 Fournier ..... F23D 5/045 126/116 B
4,194,490 A 3/1980 Crnkovic
4,201,186 A 5/1980 Paquin
D269,994 S 8/1983 Jenkins
4,688,548 A * 8/1987 Stoughton ..... F24B 1/191 126/152 B
4,706,642 A * 11/1987 Sims ..... F24B 1/205 126/9 B
4,886,047 A 12/1989 Bonin
5,850,830 A 12/1998 Smith
D616,977 S 6/2010 Asofsky et al.
D769,435 S 10/2016 Hrydovyy
2011/0283528 A1 11/2011 Spinner
2015/0034064 A1 2/2015 Villarreal Escamilla et al.

FOREIGN PATENT DOCUMENTS

CN 20267189 8/2014
GB 2087542 A 8/1982

* cited by examiner

*Primary Examiner* — Avinash A Savani
(74) *Attorney, Agent, or Firm* — Kevin P Weldon

(57) ABSTRACT

A wood stove including a stove body which defines a stove exterior, a stove interior, and a combustion chamber disposed within the interior. A temporary cast iron insert is placed within the combustion chamber, the insert includes a horizontal base and vertical wall. The vertical wall substantially bisects the horizontal base. Fuel may be placed only on one side of the vertical wall during milder weather that does not require the full heating capacity of the stove. The cast iron insert improves the thermal efficiency of the stove whenever lesser amounts of logs are burned.

14 Claims, 3 Drawing Sheets

WOOD STOVE INSERT

FIELD OF THE DISCLOSURE

This disclosure relates generally to wood burning stoves. In particular, this disclosure relates to wood burning stoves having an insert for regulating combustion and thermal heating of a building, including methods of using the insert with a stove.

BACKGROUND OF THE DISCLOSURE

Wood burning stoves, so named because wood is the principal fuel used with them, have existed for many years. Most such stoves are of generally rectangular box-like shape and are fabricated from iron, steel plate or another metal. Common to virtually all wood burning stoves are a combustion chamber or fire box in which the wood is placed for burning; draft inlet means to admit air to the fire chamber for combustion of the wood; and a flue or smokestack to allow hot gases and fumes from the fire to escape from the fire chamber. When in use a wood stove provides heat by radiation from the hot metal surfaces to the air of the building spaces where they are located. Most wood stoves rely principally upon radiation for transferring heat into the room they are located. They often tend to have extremely hot outer surfaces, typically 300° F.-350° F.

Stoves are becoming more widely used as sources of heat for homes, cabins, and the like. These stoves burn wood or coal, or the like, as fuel and have many designs for inputting heat to a room or other such enclosures. Stoves have become commonplace in both residential and commercial applications for situations where a fireplace is not feasible or desired. In some instances, wood burning stoves have been inserted into fireplace boxes because stoves heat spaces more efficiently. Most stoves are able to burn for extended periods of time, such as overnight, without refueling or reloading, further enhancing the preference over fireplaces.

A hot raging fire burns more efficiently than a colder smoldering fire. In a smoldering fire a portion of the gases do not reach the required combustion temperature and exit the stove without burning. These gases are wasted fuel and pollutants. It is therefore better to have a smaller hot fire than a big smoldering fire. Hotter gases rise faster up the flue drawing in air quicker supplying the oxygen for combustion of the wood. The airflow patterns during combustion of wood are a principal cause in fuel combustion efficiency. Adequate air circulation is required to supply the necessary amount of oxygen for the chemical oxidation reaction with the wood cellulose. For rapid combustion and greater air circulation is required. With rapid combustion comes greater temperatures.

Combustion efficiency is a valuable part of a stove evaluation for a home, but it is only one part of the evaluation process and cannot be used as the sole reason or justification for purchasing, keeping or replacing existing equipment. If the excess air is carefully controlled, most stoves are capable of performing at high combustion efficiency.

The ultimate thermal efficiency of the stove is determined by dividing the heat output rate of the appliance by the rate of fuel input. During the combustion process, all stoves that operate with the same combustion efficiency will produce the same amount of heat with the same fuel input. The combustion efficiency has no bearing on how well the stove transfers the produced heat to a building space after the combustion process has taken place. Heat exchanger design and its ability to transfer the heat to the room determines how well the heat produced by the combustion process is utilized.

Typically, such stoves described above and other type heating stoves are designed so as to most efficiently generate heat from a supply of wood whenever the combustion chamber is substantially filled to its recommended wood fuel capacity. Stoves are typically given a heating capacity rating in BTU/hr and selected by the home owner or builder so as to provide adequate heating of a house or room during typical winter weather daytime low temperatures for that location. For instance, in central Canada a 100K btu/hr might be selected for a 1,000 square foot home but only a 50K btu/hr rated stove is required in more temperate Seattle Washington to provide the same comfortable inside house temperatures during winter. The combustion chamber sizes of the same type wood stoves having 100K btu/hr rating vs a 50K btu/hr are predictably substantially larger. If a stove having a 100K btu/hr heating capacity rating was installed in the above described Seattle Washington house the operator would seldom if ever have need to put in a quantity of wood equal to the recommended full load. Operation of a wood stove at less than its recommended full capacity results in the stove operating at a less than optimum thermal efficiency possibly poorer fuel efficiency and possibly poorer stack emissions.

It may just happen to be that such described above house in central Canada one year or more has milder winter temperatures similar to a typical winter in Seattle Washington. The wood stove during such mild winters would only have to be partially filled with respect to its recommended full capacity for wood during the winter and as a result the stove is unnecessarily large and inefficient.

Whenever a combustion chamber is for instance only half filled with wood of its recommended capacity the wood cannot be stacked near as high initially and is proportionally more horizontal than a more fully packed firebox. Cheaper firewood that is typically employed in stoves has its natural circular cross section and as a result has a tendency to roll and is very difficult to stack very highin a freestanding manner on the bottom horizontal surface of stove. Even more expensive split firewood on account of its remaining arcuate surfaces can be difficult to stack in a more vertical manner in a freestanding manner inside the stove. As the half filled sized fire progresses the embers form and fall onto the bottom of the fire box and cover a relatively broader area in comparison to the height of the embers. This relatively flatter pile of resulting embers radiates much of its heat toward the top wall of the stove and even less to the sidewalls, back wall and front door than the original firewood.

Grates for holding wood in fireplaces have been known for many years. Conventional flat grates require constant attention and toil to maintain a warm fire. As the fire burns and the wood is consumed, the contents shift and break apart. The end result is a smoldering fire that has lost its hot nucleus and must be "pushed" back together to maintain. However, the present inventor is not aware of any such type element which improves the efficiency of lesser amounts, such as nearly half the recommended wood capacity, of burning wood more productively.

During milder winters, what is desired is a stove that may operate with substantially lesser amounts of wood at a high thermal efficiency.

The present invention relates to stoves, and, more particularly, to easily adapting a stove to temporarily improve its thermal efficiency during milder winter weather.

SUMMARY OF THE DISCLOSURE

A stove including a stove body which defines a stove exterior, a stove interior, and a combustion chamber disposed within the interior. A temporary metal insert may be placed within the combustion chamber, the insert includes a horizontal base and vertical wall. The vertical wall substantially bisects the horizontal base. Fuel may be placed on just one side of the vertical wall during milder weather that does not require the full heating capacity of the stove.

A stove including a stove body which defines a stove exterior, a stove interior, and a combustion chamber disposed within the interior. A temporary cast iron insert is placed within the combustion chamber, the insert includes a horizontal base and vertical wall. The vertical wall substantially bisects the horizontal base. Fuel may be placed only on one side of the vertical wall during milder weather that does not require the full heating capacity of the stove.

A stove including a stove body which defines a stove exterior, a stove interior, and a combustion chamber disposed within the interior. A temporary metal insert is placed within the combustion chamber, the insert includes a horizontal base and vertical wall. The horizontal base covers most the bottom floor of the combustion chamber. The vertical wall substantially bisects the horizontal base and combustion chamber. The vertical wall has a height that is substantially ⅔ the height of the height of the combustion chamber.

A stove including a stove body which defines a stove exterior, a stove interior, and a combustion chamber disposed within the interior. A temporary cast iron insert is placed within the combustion chamber, the insert includes a horizontal base and vertical wall. The horizontal base covers most the bottom floor of the combustion chamber. The vertical wall substantially bisects the horizontal base and combustion chamber. The vertical wall has a height that is at least ½ the height of the combustion chamber and parallel with a side wall of the stove. The cast iron insert improves the thermal efficiency of the stove.

A temporary cast iron insert that can store a large amount of thermal energy and also radiates heat for longer time period, the insert includes a horizontal base and perpendicular to the base a vertical wall. The horizontal base covers most the bottom floor of a combustion chamber. The vertical wall substantially bisects the horizontal base and combustion chamber. The insert efficiently radiates thermal energy.

It is an object of the present invention to provide a simple and effective way of converting a wood stove designed to operate at high thermal efficiency at a recommended full fuel capacity to also operate at a high thermal efficiency with a much small amount of fuel than the recommended full fuel load capacity. In particular it is desirable to provide a simple and effective way of temporarily modifying and operating a wood stove so that it operates at a high thermal efficiency at half its recommended maximum wood capacity.

A method of temporarily modifying a stove so that it may operate at substantially the same thermal efficiency as when the unmodified stove is burning the recommended full capacity of wood fuel.

With the present invention insert the wood is stacked higher and as embers form and crumble such a higher stack forms a higher deeper pile of embers that does not have to be pushed back together to form a hot self-sustaining critical mass of embers.

This together with other objects and advantages which will become subsequently apparent reside in the details of construction and operation as more fully hereinafter described and claimed, reference being had to the accompanying drawings forming part hereof, wherein like reference numerals refer to like parts throughout.

DETAILED DESCRIPTION OF THE PREFERRED EMBODIMENT

Wood is generally burned in household heating stoves, although other types of solid fuels can also be burned in stoves and the stove of the present invention. The following description and figures are in reference to a wood burning stove, although it is to be understood that the function of the stove elements is not necessarily dependent on the type of fuel burned.

Figure 1:
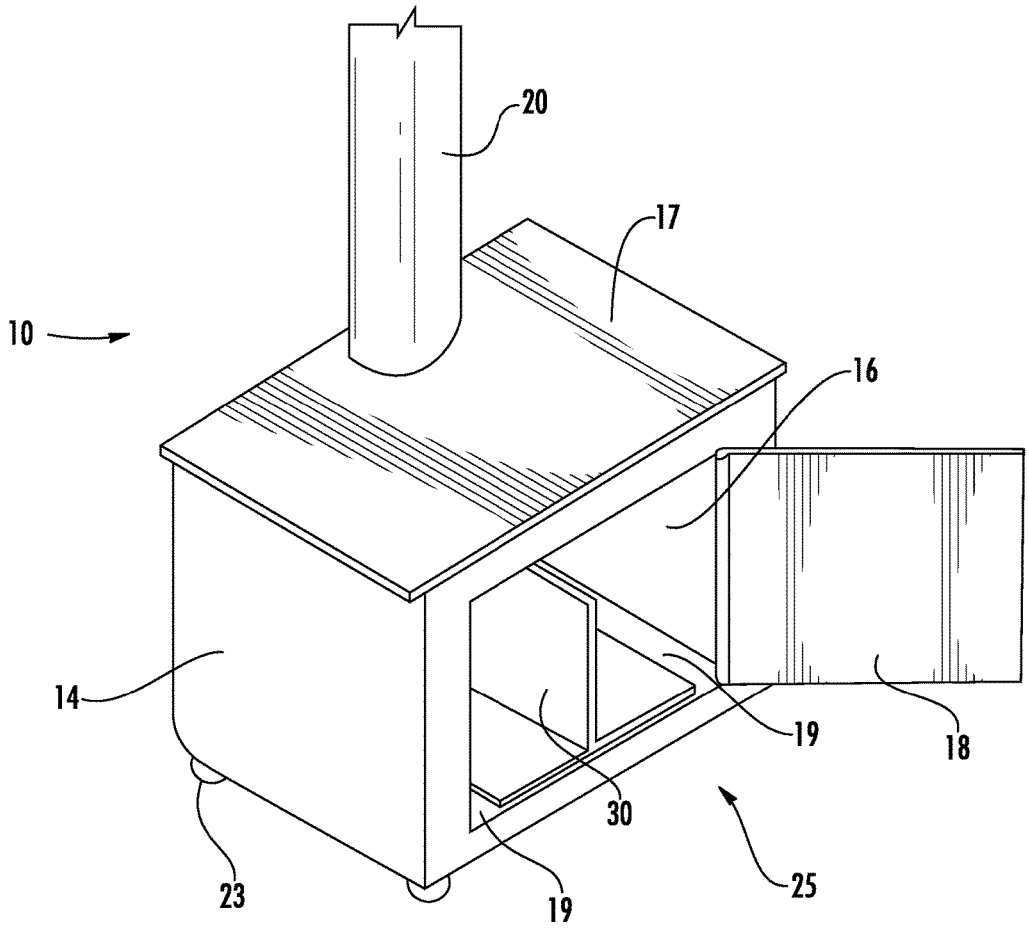
FIG. 1 is a perspective of a stove having therein an insert member embodying the teachings of the present invention.

A stove 10 is shown in FIG. 1. Stove 10 has a combustion chamber 25 defined by first side wall 14, opposite second side wall 16, a top wall 17, a front wall having a hinged door 18, a bottom wall 19, and a back wall 15, not shown in FIG. 1. Together, these various wall define a combustion chamber 25 within the walls. The stove may be atop an elevated footer or have legs 23 which elevates the stove above the surface on which it is supported, including a floor for instance. Typically, the stove 10 is metal, including but not limited to cast iron. A larger portion of the heat generated by fuel combustion radiates toward and is absorbed by the metal sidewalls, bottom and top of the stove. An amount of the upwardly radiating heat goes out the flue 20. The stove temperature rises as heat is absorbed from the fire in the combustion chamber 25, and this absorbed heat is then radiated to the lower temperature room air, wall surfaces and other objects surrounding the stove. A stove efficiently dissipates its heat into the surrounding room by both natural air convection and radiation. The natural air convection occurs on account of local heat gradients that arise within the room. For example, as air next to the stove surfaces is heated it rises towards the room ceiling and is replaced by cooler room temperature air creating a natural air circulation cycle.

The door 18 is disposed on the front wall, however, the door can be provided on any of the side walls or the back wall of stove 10. Door 18 is pivotally openable on a hinge attached to the front wall. A handle may facilitate opening and closing of the door. Door 18 may in one preferred embodiment include a window to allow viewing of the combustion chamber 25 within the stove 10. The door 18 can be used to place fuel, such as wood logs, into the combustion chamber 25 of stove 10.

A flue, flue or chimney 20 is provided to allow the exhaust gases generated by the burning fuel to exit the stove 10. Included in stove 10 are various air intake apertures and channels, to provide air to the interior of the combustion chamber. The stove may include dampers used to manipulate the flow of intake air.

Figure 2:
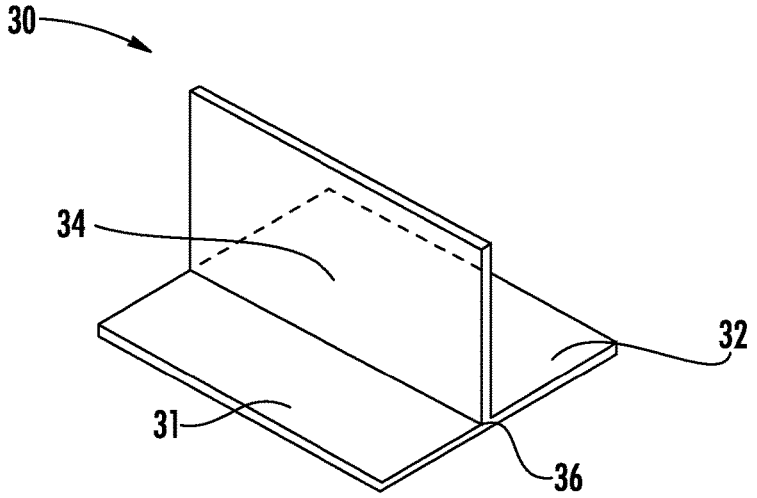
FIG. 2 is a perspective of an insert member embodying the teachings of the present invention.

Within the stove in FIG. 2 is an insert 30 for improving the thermal efficiency of the stove whenever substantially lesser amounts of wood than the stoves recommended full fuel capacity are required. The insert 30 comprises of a horizontal base and vertical wall 34. The vertical wall is perpendicular to the horizontal base and extends from a front edge 36 of the base to its rear edge, not shown. The vertical wall substantially bisects the horizontal base into two equal halves 31 and 32. The vertical wall 34 may be welded to the base 32 employing a bond that has a much higher melting temperature than those temperatures that may arise while burning a heating fuel in the stove. Alternatively the vertical wall may be attached to the base using a bracket and bolts or other well-known means for fastening one substrate perpendicular to another substrate.

Figure 3:
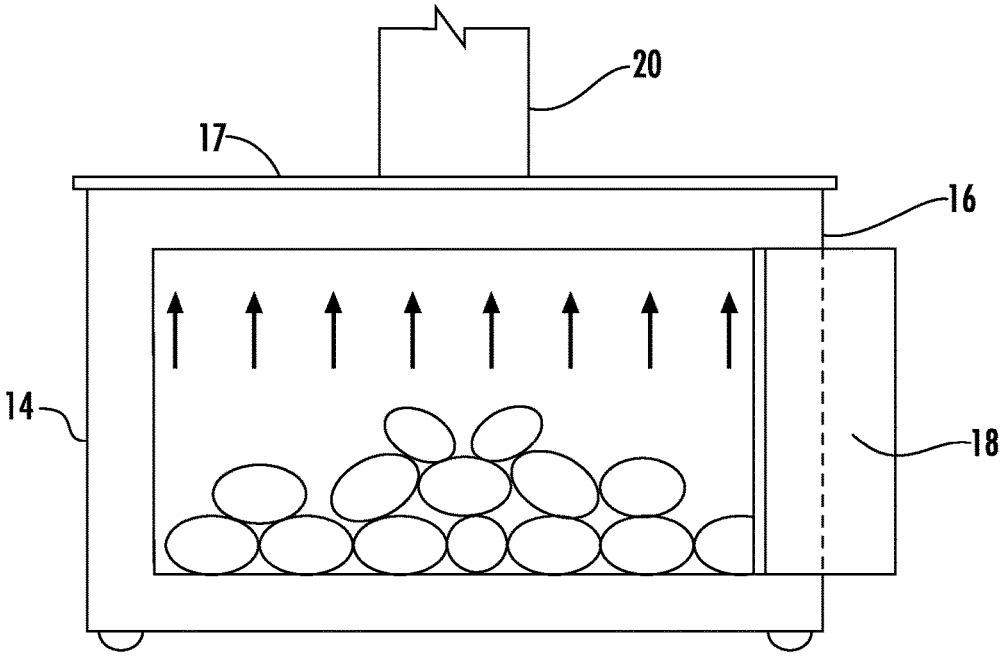
FIG. 3 is a front view of FIG. 1 with half the amount of the recommended full capacity of wood loaded in a stove without the insert.
Figure 4:
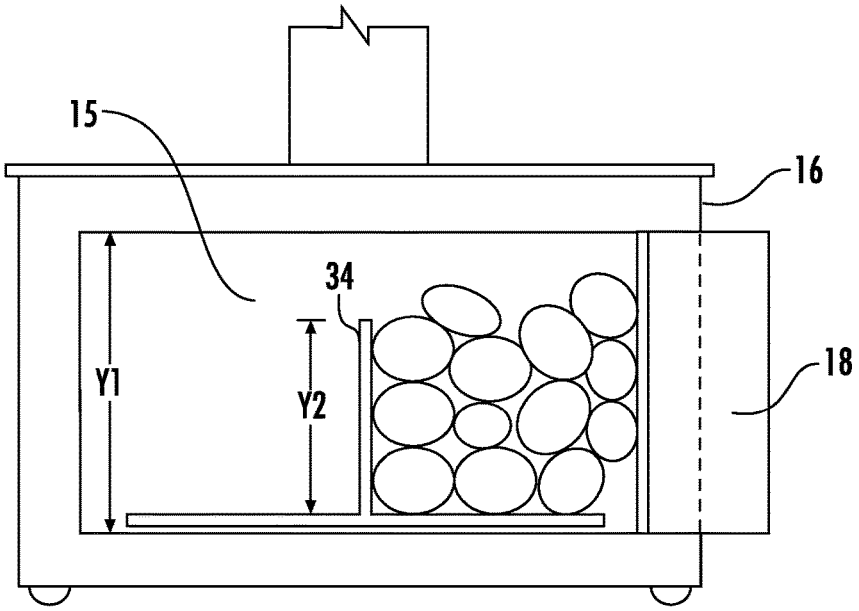
FIG. 4 is a front view showing the stove of FIG. 3 with half the amount of the recommended full capacity of wood loaded but with the insert positioned therein.

As seen in FIG. 4 the height Y2 of the vertical wall 34 of the insert is approximately ⅔ the height Y1 of the combustion chamber. As seen in FIG. 4 the logs (unnumbered) are stacked against the vertical wall 34 which provides support for the logs. The vertical wall accommodates stacking logs in higher configuration. That is, although logs may not be stacked precisely one on top of the other and may instead be staggered to an extent, they are limited and supported horizontally on at least one side by the vertical wall 34 so as to form an overall cross sectional configuration that is substantially higher than when an identical amount of wood is stacked in the combustion chamber without an insert, see FIG. 3. The insert vertical wall 34 is positioned near the center of the stove for more even distribution of heat to all the walls of the stove.

When a load of wood is stacked in the stove without an insert, see FIG. 3, much of the heat from the logs (unnumbered), the bold arrows directed away from the stacked logs represents that heat radiation directed to the top surface of the stove, a larger portion of the heat radiation generated by the burning logs is directed upward on account of such wood stacks must be generally stacked in a pyramid shape requiring a broader horizontal base in proportion to the wood stacks vertical height. Accordingly, much of the radiant heat emitted from the wood stack in FIG. 3 is directed toward the top of the stove and the flue. The progression of the fire eventually turns the logs into embers which are great sources of radiant heat. The embers fall down beneath and eventually onto the bottom of the stove generally forming a hot ember pile that is a geometrically reminiscent of the original wood stack but shorter.

Figure 5:
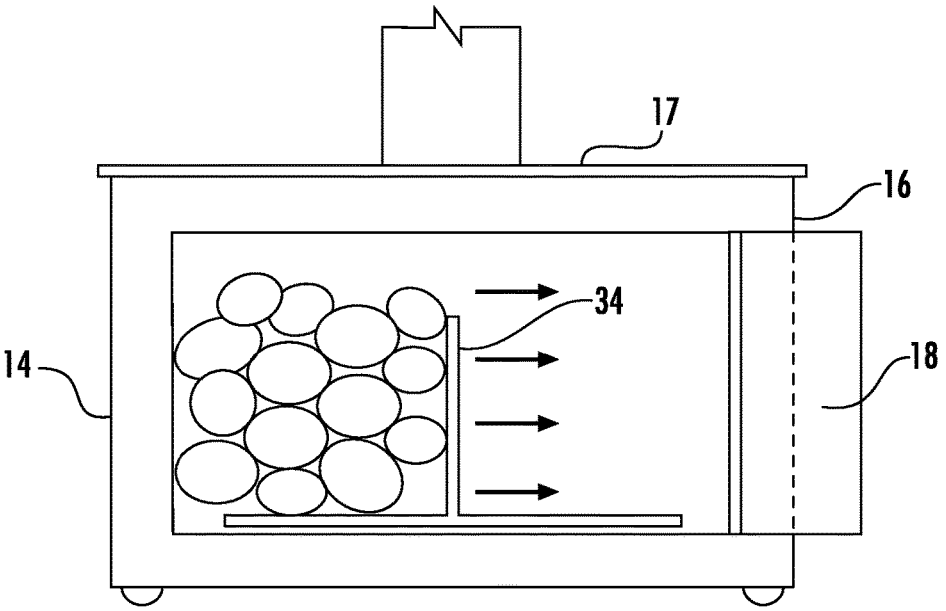
FIG. 5 is a front view showing the stove of FIG. 3 with half the amount of the recommended full capacity of wood loaded in a stove but with the insert positioned therein, however the wood is stacked on the opposite side of the insert as shown in FIG. 4.

In contrast a higher original configuration of logs is achievable with the same amount of logs when employing the insert 30. This higher stack of logs radiates proportionately more heat toward the side walls, front wall and back wall. A greater proportional amount of radiation heat, as represented by the bold arrows, in FIG. 5, it is directed at and absorbed by sidewall 16, likewise heat radiation (not depicted by radiation arrows) is directed to back wall 15, door 18 and sidewall 14 with a lesser proportional amount of radiated heat directed at and absorbed by the top 17 and also a lesser amount radiated heat out the flue 20 in comparison to the equivalent amount of wood stacked without an insert, see FIG. 3.

The heat radiating from the stack of logs is also absorbed by vertical wall 34. The heat in wall 34 is then nearly all radiated toward and absorbed by sidewall 16, see FIG. 5. The logs in FIG. 5 conduct and radiate heat to the insert base half 31, this heat is conducted by direct contact to the bottom floor 19 of the stove. The heat absorbed by the base 31 is conducted horizontally about the base of the insert and to the bottom floor of the stove by virtue of its direct contact with the bottom floor 19.

The logs are initially stacked higher against the vertical wall in FIG. 4, therefor as the logs burn the accumulated built up pile of embers will be proportionally deeper in comparison to the resulting generally pyramid pile of embers resulting from an equivalent amount of logs stacked in typical pyramid style as shown in FIG. 3. The resulting more vertical deeper ember bed of course also radiates more heat horizontally as compared with the alternative resulting pyramid bed of hot embers that results from the original generally pyramid stack of logs in FIG. 3 when stacking without an insert. The greatest exposure of the resulting hot ember much flatter pyramid pile occurs horizontally with a very small amount of radiant heat directed at the stove sidewalk back and door. The use of the insert 30 lessens the degree of horizontal exposure and increases radiation directed to the sidewalls, back and door by limiting the hot embers horizontal exposure to about half the area of the stove bottom and causing the embers to pile deeper. The use of the insert 30 of the present invention causes more even distribution of radiant heat from the combustion chamber amongst all the exterior walls of the stove. It is believed that overall stove heat radiation into an adjacent building space is increased with the cast iron insert of the present invention in comparison to the same stove without an insert in the combustion chamber.

It will also be understood that while a wood fueled stove will be described with respect to the preferred embodiments, the disclosure is not limited to stoves burning wood, but could equally apply to stoves using other fuel sources. Further, while the present disclosure described is made of cast iron the disclosure is not to be limited to any particular material, but could be used with other known constructions, such as steel, aluminum and other known materials.

Although the stove body is described with six walls (four periphery side walls, a top wall and a bottom wall), body can be any shape. The above description of a stove has been fairly general. It is understood that any variation in the structure of a stove can be used with an appropriately shaped insert corresponding to the stove body. These and other modifications of the disclosure will be understood by those skilled in the art in view of the above description.

The invention claimed is:

1. A stove comprising:

a stove body which defines a stove exterior, a stove interior, a bottom floor and a combustion chamber disposed within the interior, a removable temporary metal insert placed within the combustion chamber, the insert includes a horizontal base and vertical wall, wherein the vertical wall of the insert bisects the horizontal base, and the horizontal base rests on the bottom floor of the stove, the temporary metal insert comprises cast iron.

2. The stove according to claim 1, wherein said combustion chamber has a vertical height from a bottom to a top wall and said vertical wall has a height that is approximately ⅔ said height of said combustion chamber.

3. The stove according to claim 2, wherein said stove has at least one side wall and said vertical wall is parallel with said at least one side wall of the stove.

4. The stove according to claim 2, wherein said base of the insert covers most said bottom of said combustion chamber.

5. The stove according to claim 3, wherein said base of the insert covers most said bottom of said combustion chamber.

6. A stove comprising:

a stove body which defines a stove exterior, a stove interior, a bottom floor and a combustion chamber disposed within the interior, a removable temporary cast iron insert placed within the combustion chamber, the insert includes a horizontal base and vertical wall wherein the vertical wall of the insert bisects the horizontal base, and the horizontal base rests on the bottom floor of the stove.

7. The stove according to claim 6, wherein said combustion chamber has a vertical height from said bottom floor to a top wall.

8. The stove according to claim 7, wherein said vertical wall has a height that is approximately ⅔ said height of said combustion chamber.

9. The stove according to claim 7, wherein said base of the insert covers most of said bottom floor of said combustion chamber.

10. The stove according to claim 8, wherein said base of the insert covers most said bottom floor of said combustion chamber.

11. The stove according to claim 10, wherein said metal insert has a high heating capacity.

12. The stove according to claim 11, wherein said metal insert has a high thermal energy storage.

13. The stove according to claim 1, wherein said combustion chamber has a vertical height from a bottom to a top wall and said vertical wall has a height that is less than said height of said combustion chamber.

14. The stove according to claim 7, wherein said vertical wall has a height that is less than said height of said combustion chamber.

* * * * *